US006986978B2

(12) United States Patent
Nukada et al.

(10) Patent No.: US 6,986,978 B2
(45) Date of Patent: Jan. 17, 2006

(54) APPARATUS FOR FORMING IMAGE, PROCESS CARTRIDGE AND PROCESS FOR REGENERATING THE SAME

(75) Inventors: Katsumi Nukada, Minamiashigara (JP); Wataru Yamada, Minamiashigara (JP); Rie Ishii, Minamiashigara (JP); Mieko Seki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 10/318,076

(22) Filed: Dec. 13, 2002

(65) Prior Publication Data

US 2003/0118366 A1 Jun. 26, 2003

Related U.S. Application Data

(63) Continuation of application No. 09/706,785, filed on Nov. 7, 2000, now abandoned.

(30) Foreign Application Priority Data

Mar. 2, 2000 (JP) ..... 2000-056962

(51) Int. Cl.
*G03G 21/10* (2006.01)
*G03G 15/00* (2006.01)

(52) U.S. Cl. ..... 430/125; 430/97; 399/109; 399/159; 399/350; 399/357; 399/359

(58) Field of Classification Search ..... 399/109, 399/159, 359, 357, 350; 430/125, 97
See application file for complete search history.

(56) References Cited

U.S. PATENT DOCUMENTS

| | | | | |
|---|---|---|---|---|
| 4,931,841 | A * | 6/1990 | Yoshihara | 399/350 |
| 5,008,706 | A | 4/1991 | Ohmori et al. | |
| 5,363,176 | A | 11/1994 | Ishihara et al. | |
| 5,486,443 | A * | 1/1996 | Grande et al. | 430/106.2 |
| 5,849,453 | A * | 12/1998 | Mikuriya et al. | 430/125 |
| 5,878,317 | A * | 3/1999 | Masuda et al. | 399/359 |
| 5,879,847 | A | 3/1999 | Yoshinaga et al. | |
| 6,046,348 | A * | 4/2000 | Yamada et al. | 556/413 |
| 6,203,962 | B1 * | 3/2001 | Itami et al. | 430/125 |
| 6,294,303 | B1 * | 9/2001 | Putnam et al. | 430/108.6 |
| 6,296,978 | B1 | 10/2001 | Takaya et al. | |

FOREIGN PATENT DOCUMENTS

| | | |
|---|---|---|
| JP | 47-30330 | 11/1972 |
| JP | A-61-238062 | 10/1986 |
| JP | A 61-238062 | 10/1986 |
| JP | A 62-108260 | 5/1987 |
| JP | A-62-108260 | 5/1987 |
| JP | A-1-133086 | 5/1989 |
| JP | A-1-161279 | 6/1989 |
| JP | A-3-191358 | 8/1991 |
| JP | A 4-273252 | 9/1992 |
| JP | A-4-273252 | 9/1992 |
| JP | A-4-346356 | 12/1992 |
| JP | A 4-346356 | 12/1992 |
| JP | A-6-75384 | 3/1994 |
| JP | A-7-225541 | 8/1995 |
| JP | A-7-311470 | 11/1995 |
| JP | A-7-333881 | 12/1995 |
| JP | A 7-333881 | 12/1995 |
| JP | A-8-176293 | 7/1996 |
| JP | A-8-208820 | 8/1996 |
| JP | 2-575536 | 10/1996 |
| JP | 2575536 | 10/1996 |
| JP | A 8-319353 | 12/1996 |
| JP | A-8-319353 | 12/1996 |
| JP | A-9-19004 | 1/1997 |
| JP | A-9-124665 | 5/1997 |
| JP | A 9-190004 | 7/1997 |
| JP | A-9-190004 | 7/1997 |
| JP | A-11-38656 | 2/1999 |
| JP | A-11-184106 | 7/1999 |

OTHER PUBLICATIONS

Diamond, Arthur S. (editor) Handbook of Imaging Materials. New York: Marcel-Dekker, Inc. (1991) pp. 159-165 & 201-213.*

Diamond, Arthur S. & David S. Weiss. (editors) Handbook of Imaging Materials, 2nd ed. New York: Marcel-Dekker, Inc. (Nov. 2001) pp. 145-164.*

Fuji Xerox XP-11, Product Specification (Aug. 1989) one page.*

* cited by examiner

*Primary Examiner*—Christopher Rodee
(74) *Attorney, Agent, or Firm*—Oliff & Berridge, PLC

(57) ABSTRACT

An apparatus for forming an image that can stably provide an image for a long period of time is provided by using an electrophotographic photoreceptor having, as the outermost layer, a hard film containing one or more of a charge transporting organic silicon compound. It is an apparatus for forming an image containing a photoreceptor having, as an outermost layer, a hard film containing one or more of a charge transporting organic silicon compound represented by the following general formula (I), the outermost layer having a wear rate of about from 5 to 30 nm per 1,000 revolutions of the photoreceptor:

$$F\text{-}[D\text{-}A]_b. \quad (I)$$

15 Claims, 3 Drawing Sheets

APPARATUS FOR FORMING IMAGE, PROCESS CARTRIDGE AND PROCESS FOR REGENERATING THE SAME

FIELD OF THE INVENTION

The present invention relates to an apparatus for forming an image having an electrophotographic photoreceptor having a charge transporting organic silicon compound on an outermost layer, a process cartridge and a process for regenerating the same.

BACKGROUND OF THE INVENTION

In recent years, the so-called function separated type electrophotographic photoreceptor is developed and subjected to practical use from the standpoint of sensitivity and stability, in which a charge generating layer and a charge transporting layer are separated from each other. The electrophotographic photoreceptor having such a constitution contains two layers, i.e., a layer having a charge generating substance bound with an appropriate resin as a binder and a layer having a charge transporting material dispersed or dissolved in a binder resin. The layer containing the charge transporting material contains, in many cases, a hole transporting material, and a thermoplastic resin, such as a polycarbonate resin, a polyester resin, an acrylic resin and a polystyrene resin, and a thermosetting resin, such as a polyurethane resin and an epoxy resin, are investigated as a binder therefor. In this case, the surface of the charge transporting layer should be charged negatively by corona discharge or roller discharge, and there is a problem in that the photoreceptor characteristics are deteriorated due to various factors, in which deterioration of the resin caused by ozone formed thereon, wear-out and deterioration in sensitivity and charging ability caused by an electric shock due to discharge carried out on the surface of the photoreceptor, and mechanical breakage caused by friction on development with a toner, transfer to paper and cleaning.

Various studies have been conducted to solve the problem. For example, the following methods are proposed, i.e., a method described in JP-A-1-161279, in which an abrasion device of an electrophotographic photoreceptor is provided on an ordinary photoreceptor and used at an abrasion amount of from 1 to 1.5 $\mu$m per 10,000 sheets of duplication, whereby contamination substances on the surface are removed; a method described in JP-A-6-75384, in which a photoreceptor is used at an ozone concentration around the photoreceptor of from 5 to 50 ppm and an abrasion amount of 300 Å per 1,000 revolutions; and a method described in JP-A-7-311470, in which the pressing force of a cleaning blade onto the photoreceptor is specified to a particular value, which is used at an abrasion amount on the cleaning process of from 0.05 to 1.0 $\mu$m per 1,000 cleaning cycles, and a releasing agent having a number average domain diameter of from 0.1 to 1.1 $\mu$m is added to a toner. However, these methods can be applied to a non-contact charging process, such as corotron and scorotron, but in a contact charging process represented by the roller charging, it causes a problem in that the charging stress is large to increase the wear rate, which substantially cannot be controlled, so as to shorten the service life of the photoreceptor, and thus an outermost layer having higher strength becomes necessary.

In order to improve the strength of the outermost layer, it has been studied to provide various overcoat layers. In particular, it has been tried that a polysiloxane resin is used as a copolymer component or is mixed with other resins, described in JP-A-61-238062, in which a thermosetting resin containing a polysiloxane resin is used in a charge transporting layer, in JP-A-62-108260, in which a protective layer containing a polysiloxane resin is provided, in JP-A-4-346356, in which silica gel, a urethane resin and a fluorine resin are dispersed in a thermosetting polysiloxane resin, which is used as a protective layer, and in JP-A-4-273252, in which a resin obtained by dispersing a thermosetting polysiloxane resin in a thermoplastic resin is used as a protective layer or a binder resin for a charge transporting material, whereby improvements in performance, service life and cleaning property of the photoreceptor are studied by utilizing the characteristics of polysiloxane.

However, because polysiloxane is extremely poor in compatibility with an organic compound although it has characteristics, such as transparency, dielectric breakdown resistance and photostability, as well as a low surface tension, which are not found in other resins, it is not used solely as a resin for constituting a charge transporting material but is used for modifying a resin for constituting a charge transporting material by copolymerization or blending. In order to use the polysiloxane resin solely as a binder for constituting the charge transporting layer, it is necessary to find out a charge transporting substance that can be dissolved in the polysiloxane resin.

Therefore, the following studies have been made, i.e., a resin obtained by directly bonding a charge transporting agent having an unsaturated bond to polysiloxane, such as poly(hydrogenmethylsiloxane), by hydrosililation is used as a protective layer or a binder resin for a charge transporting material (described in JP-A-8-319353), an inorganic thin film formed by plasma CVD is used as a protective layer (described in JP-A-7-333881), a thin film formed by a sol-gel process is used as a protective layer (described in *Proceedings of IS&T's Eleventh International Congress on Advances in Non-Impact Printing Technologies*, pp. 57 to 59), and an organic silicon modified hole transporting compound formed by directly introducing a silicon group having a hydrolytic group to a charge transporting agent is used in an electrophotographic photoreceptor (described in JP-A-9-190004) Among these, those described in *Proceedings of IS&T's Eleventh International Congress on Advances in Non-Impact Printing Technologies*, pp. 57 to 59, Japanese Patent No. 2,575,536 and JP-A-9-190004 receive attention because siloxane forms a three-dimensional network to form a firm film, and thus the mechanical strength is greatly improved.

A photoreceptor having such a layer having a high strength as, for example, an overcoat layer is liable to form image defects due to surface contamination, since the wear amount thereof is generally small. Therefore, the following methods have been proposed, i.e., a protective layer of a high strength is provided on an organic photoreceptor, which is used at a wear amount of from 7 to 200 Å (from 0.0007 to 0.02 $\mu$m) per 10,000 sheets of duplication as described in JP-A-1-133086, and it is used with wearing in an amount of from 0.001 to 0.010 $\mu$m per 1,000 revolutions as described in JP-A-7-225541. Because a hard layer having a charge transporting material introduced into a three-dimensional network of siloxane by a chemical bond becomes a semiconductor, it is advantageous that horizontal diffusion of charge can be prevented with respect to an insulating layer, an ion electroconductive layer or a surface protective layer formed with a resistance controlling layer having electroconductive powder dispersed in a dielectric polymer, so as to form a stable image.

However, in the case where a surface layer containing a three-dimensional network of siloxane having a charge transporting material contained therein is employed, because siloxane contains a large amount of unreacted hydroxyl groups as the nature thereof, a product of corona discharge and moisture are liable to be adsorbed on the surface thereof. Furthermore, the mechanical strength thereof is larger than that of the ordinary charge transporting layer by 10 to 20 times, and thus the adsorbed substances are liable to remain for a long period of time.

Therefore, it has a problem in that a reaction between the charge transporting material and the adsorbed substances is liable to occur, and the reacted and deteriorated charge transporting material remains on the surface layer to frequently cause image defects. Thus, development of an apparatus for forming an image that solves the problem to realize a long service life is demanded.

SUMMARY OF THE INVENTION

The invention has been made to solve the problems associated with the conventional technologies and to provide an apparatus for forming an image that stably provides an image for a long period of time by using an electrophotographic photoreceptor having a hard film containing one or more of a charge transporting organic silicon compound as an outermost layer, a process cartridge and a process for regenerating the same.

The invention relates to, as a first aspect, an apparatus for forming an image containing a photoreceptor having, as an outermost layer, a hard film containing one or more of a charge transporting organic silicon compound represented by the following general formula (I), the outermost layer having a wear rate of about from 5 to 30 nm per 1,000 revolutions of the photoreceptor:

$$F\text{-}[D\text{-}A]_b \qquad (I)$$

wherein F represents an organic group derived from a charge transporting compound; D represents a flexible sub-unit; A represents a substituted silicon group having a hydrolytic group represented by $—Si(R_1)_{(3-a)}Q_a$, wherein $R_1$ represents hydrogen, an alkyl group or a substituted or unsubstituted aryl group, Q represents a hydrolytic group, and a represents an integer of from 1 to 3, and b represents an integer of from 1 to 4.

The invention also relates to, as a second aspect, an apparatus for forming an image of the first aspect, wherein the apparatus further contains a developing unit, and the developing unit has a drawspan that capacitates to recharge a toner or a developer.

The invention also relates to, as a third aspect, a process cartridge containing a photoreceptor having, as an outermost layer, a hard film containing one or more of a charge transporting organic silicon compound represented by the general formula (I), the outermost layer having a wear rate of about from 5 to 30 nm per 1,000 revolutions of the photoreceptor.

The invention also relates to, as a fourth aspect, a process cartridge of the third aspect, wherein the process cartridge further contains a developing unit, and the developing unit has a drawspan that capacitates to recharge a toner or a developer.

The invention also relates to, as a fifth aspect, a process for regenerating an apparatus for forming an image, the process containing a step of recharging a toner or a developer in an apparatus for forming an image of the first or second aspect.

The invention also relates to, as a sixth aspect, a process for regenerating a process cartridge, the process containing a step of recharging a toner or a developer in a process cartridge of the third or fourth aspect.

BRIEF DESCRIPTION OF THE DRAWINGS

Preferred embodiments of the invention will be described based on the following figures, wherein.

DETAILED DESCRIPTION OF THE INVENTION

Figure 1:
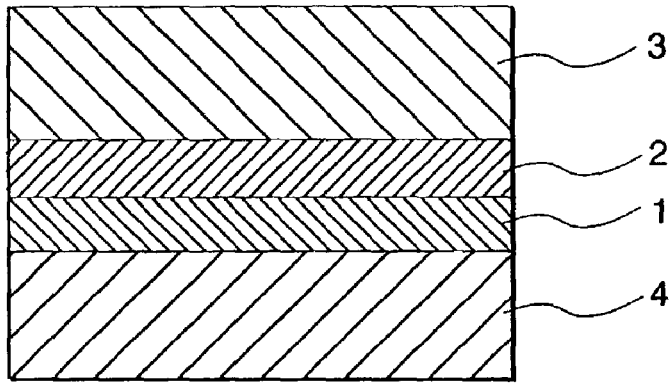
FIG. 1 is a schematic cross sectional view of an example of an electrophotographic photoreceptor used in an apparatus for forming an image according to the invention.

The invention will be described in detail below.

Apparatus for Forming Image

The apparatus for forming an image of the invention contains a photoreceptor having, as an outermost layer, a hard film containing one or more of a charge transporting organic silicon compound represented by the general formula (I) (hereinafter sometimes referred to as "the specific hard film"), and the outermost layer has a wear rate of about from 5 to 30 nm per 1,000 revolutions of the photoreceptor.

In the apparatus for forming an image of the invention, the wear rate of the outermost layer containing the specific hard film is about from 5 to 30 nm per 1,000 revolutions of the photoreceptor, preferably from 5 to 25 nm, and more preferably from 5 to 20 nm. When the wear rate of the outermost layer is less than 5 nm, surface deterioration due to attached substance occurs, which causes image defects including image blurring. When it exceeds 30 nm, the outermost layer rapidly wears to cause problems in service life and cost. When the wear rate of the outermost layer containing the specific hard film is in the range described above, a stable image can be obtained for a long period of time. The wear rate of the outermost layer can be appropriately selected within the range specified above depending on the species and the thickness of the outermost layer.

In the apparatus for forming an image of the invention, the wear rate of the outermost layer containing the specific hard film can be controlled by the following methods, i.e., (1) an abrading method of abrading the surface of the electrophotographic photoreceptor during one cycle of an electrophotographic process, (2) a charging method of uniformly charging the surface of the electrophotographic photoreceptor, and (3) a cleaning method of removing a toner and dusts attached to the electrophotographic photoreceptor. The wear rate of the outermost layer can be controlled within the range by appropriately selecting these factors. The methods will be described in detail later.

The electrophotographic photoreceptor will be described in detail below.

In the apparatus for forming an image of the invention, the electrophotographic photoreceptor may have any conventional constitution as far as it has the outermost layer containing the specific hard film, and specifically, it has the outermost layer containing the specific hard film as either a photosensitive layer (a single layer photosensitive layer or an accumulated photosensitive layer (including a charge generating layer and a charge transporting layer)) or a surface protective layer on an electroconductive support. Since the specific hard film has sufficient photoelectric characteristics as well as an excellent mechanical strength, it may be used by itself as the charge transporting layer of the accumulated photosensitive layer or the surface protective layer, or in alternative, it may be used as the single layer photosensitive layer or the charge generating layer by adding a charge generating material thereto. In the case where the necessary thickness cannot be obtained by one time coating, the necessary thickness can be obtained by recoating in plural times. In the case where recoating in plural times is conducted, the heat treatment may be conducted pre each coating step or may be conducted after completing the recoating in plural times.

The specific hard film will be described in detail below.

The specific hard film is a hard film containing one or more of a charge transporting organic silicon compound represented by the following general formula (I):

$$F\text{-}[D\text{-}A]_b \quad (I)$$

wherein F represents an organic group derived from a charge transporting compound; D represents a flexible sub-unit; A represents a substituted silicon group having a hydrolytic group represented by $—Si(R_1)_{(3-a)}Q_a$, wherein $R_1$ represents hydrogen, an alkyl group or a substituted or unsubstituted aryl group, Q represents a hydrolytic group (such as an alkoxy group, a methyl ethyl ketoxime group, a diethylamino group, an acetoxy group, a propenoxy group and halogen), and a represents an integer of from 1 to 3, and b represents an integer of from 1 to 4.

A in the general formula (I) represents a substituted silicon group having a hydrolytic group represented by $—Si(R_1)_{(3-a)}Q_a$, and the substituted silicon group is a structure having a function of forming three-dimensional Si—O—Si bonds, i.e., an inorganic vitreous network, by causing a crosslinking reaction of the Si group. Specific examples of the structure of A include the structures described in JP-A-3-191358, JP-A-9-124665, JP-A-11-38656 and JP-A-11-184106.

F in the general formula (I) is an organic group having charge transporting characteristics, and examples thereof include an organic group having a structure of a triarylamine series compound, a benzidine series compound, an arylalkane series compound, an aryl substituted ethylene series compound, a stylbene series compound, an anthracene series compound or a hydrazone series compound.

D in the general formula (I) represents a flexible sub-unit and is specifically a unit for bonding F attaining the photoelectric characteristics directly to the three-dimensional inorganic vitreous network. It is a structure of imparting appropriate flexibility to the inorganic vitreous network having both rigidity and brittleness, so as to improve the strength of the film. Specific examples of D include a divalent hydrocarbon group, such as $—C_nH_{2n}—$, $C_nH_{(2n-2)}—$ and $—C_nH_{(2n-4)}—$ (wherein n represents an integer of from 1 to 15), —COO—, —S—, —O—, $—CH_2—C_6H_4—$, —N═CH—, $—(C_6H_4)—(C_6H_4)—$, a combination thereof, and those having a substituent introduced thereto.

b in the general formula (I) is preferably 2 or more. When b is 2 or more, two or more Si atoms are contained in the charge transporting organic silicon compound represented by the general formula (I), and thus the inorganic vitreous network is easily formed to increase the mechanical strength.

While the specific hard film may be formed only with the charge transporting organic silicon compound represented by the general formula (I), in order to adjust the film forming property and the flexibility of the film, a coupling agent and a fluorine compound may be used in combination. Examples of such compounds include various silane coupling agents and a commercially available silicon series hard coat agent.

In the specific hard film, it is effective to use a polymer of a molecular weight of 1,000 or more having a substituted silicon group having a hydrolytic group represented by $—Si(R_1)_{(3-a)}Q_a$ for adjusting the viscosity to control the film thickness. The polymer can be synthesized from a monomer having a substituted silicon group having a hydrolytic group represented by $—Si(R_1)_{(3-a)}Q_a$ (for example, methacryloxypropyl trimethoxysilane, methacryloxyproyl triethoxysilane, methacryloxypropylmethyl dimethoxysilane, and styrylethyl trimethoxysilane) by using azobisisobutyronitrile or benzoyl peroxide according to the known method. Furthermore, the polymer may be a copolymer by mixing a monomer, such as methyl methacrylate, methyl acrylate, styrene and acrylonitrile, at an arbitrary proportion. Because the mechanical strength becomes poor when the molecular weight is too low, it is preferably 1,000 or more in terms of styrene conversion, but because the viscosity of the solution is difficult to adjust when it is too high, it is preferably 2,000,000 or less.

Organic or inorganic fine particles may be added to the specific hard film to improve the hardness and the surface lubrication property and to prevent cracks. Examples of the organic fine particles include PTFE and polystyrene. Examples of the inorganic fine particles include silica and alumina, and inorganic fine particles having a reactive group, such as a hydroxyl group, on the surface thereof, such as those described in Proceedings of the Eighth Polymer Material Forum, 1PC06 (1999), are preferred since the dispersibility is excellent and a uniform high strength film can be easily obtained.

The specific hard film is preferably formed in the following manner. A solution containing one or more of the charge transporting organic silicon compound represented by the general formula (I) and, depending on necessity, other compounds described in the foregoing is made in contact with a solid catalyst to conduct a reaction, and then the solid catalyst is removed to produce a coating composition (hereinafter sometimes referred to as the coating composition production step). The coating composition is then coated and cured to form the specific hard film (hereinafter sometimes referred to as the hard film forming step).

In the coating composition production step, the preparation of the coating composition may be conducted without a solvent or may be conducted by arbitrarily using one kind or two or more kinds of a solvent, such as an alcohol (for example, methanol, ethanol, propanol and butanol), a ketone (for example, acetone and methyl ethyl ketone), and an ether (for example, tetrahydrofuran, diethyl ether and dioxane) depending on necessity. The solvent used preferably has a boiling point of 150° C. or less. While the amount of the solvent may be arbitrarily selected, because the charge transporting organic silicon compound is liable to be deposited when the amount is too small, the solvent is preferably used in an amount of from 0.5 to 30 parts, and more preferably from 1 to 20 parts, per 1 part of the charge transporting silicon compound.

In the coating composition production step, the reaction temperature of the reaction conducted by making the charge transporting organic silicon compound represented by the general formula (I) and, depending on necessity, other compounds described in the foregoing in contact with a solid catalyst is preferably about from 0 to 100° C., more preferably from 5 to 70° C., and particularly preferably from 10 to 50° C. The reaction time of the reaction is not particularly limited, and because gelation tends to easily occur when the reaction time becomes too long, it is preferably conducted over from 10 minutes to 100 hours.

In the coating composition production step, all the charge transporting organic silicon compound and the other compounds described in the foregoing, which are added along therewith, may be mixed at a time to be made in contact with a solid catalyst and to be reacted, or in alternative, they may be added one after another to adjust the extent of the reaction, and a part thereof may be added after removing the solid catalyst. In the case where the polymer of a molecular weight of 1,000 or more having a substituted silicon group having a hydrolytic group represented by $—Si(R_1)_{(3-a)}Q_a$ is added, because there is a case where gelation is considerably accelerated to make coating difficult when the solid catalyst and the polymer are present at the same time, the polymer is preferably added after removing the solid catalyst.

The solid catalyst finally separated in the coating composition production step is not particularly limited as far as the catalyst component is insoluble in any of the solution containing the charge transporting organic silicon compound, the other compounds described in the foregoing, water, the reaction product and the solvent. The solid catalyst may be used singly, and two or more thereof may be used in combination.

In the coating composition production step, the reaction (mainly a hydrolytic condensation reaction) is conducted by using the solid catalyst. In the mode of conducting the reaction by making the solid catalyst in contact therewith, the catalyst is arranged in a fixed bed to conduct continuously, or to conduct batchwise. The amount of the solid catalyst used is not particularly limited, and it is preferably from 0.001 to 20% by weight, and more preferably from 0.01 to 10% by weight, based on the total amount of the materials containing the hydrolytic silicon substituent group.

In the coating composition production step, at least one kind of a curing catalyst is preferably added from the standpoint of effectively obtaining the hard film having a large mechanical strength. The curing catalyst may be added to the coating composition before the reaction by contact with the solid catalyst, i.e., the solution containing the charge transporting organic silicon compound, or in alternative, may be added to the coating composition after removing the solid catalyst.

Examples of the curing catalyst include a protonic acid, such as hydrochloric acid, acetic acid, phosphoric acid and sulfuric acid, a base, such as ammonia and triethylamine, an organic tin compound, such as dibutyltin diacetate, dibutyltin dioctanoate and tin (I) octanoate, an organic titanium compound, such as tetra-n-butyl titanate and tetraisopropyl titanate, an organic aluminum compound, such as aluminum tributoxide and aluminum triacetylacatonate, and an iron salt, a manganese salt, a cobalt salt, a zinc salt and a zirconium salt of an organic carboxylic acid. Among these, from the standpoint of storage stability, the metallic compounds are preferred, and an acetylacetonate and an acetylacetate of a metal are more preferred.

In the coating composition production step, the amount of the curing catalyst used may be arbitrarily selected, and from the standpoint of storage stability, characteristics and strength, it is preferably from 0.1 to 20% by weight, and more preferably from 0.3 to 10% by weight, based,on the total amount of the materials containing the hydrolytic silicon substituent group.

In the coating composition production step, while the amount of water added to conduct the hydrolytic condensation reaction is not particularly limited, since it influences the storage stability of the reaction product and inhibition of gelation upon polymerization, the amount of water is preferably from 30 to 500%, and more preferably from 50 to 300%, of the theoretical amount necessary for hydrolysis of the entire hydrolytic groups of the materials containing the hydrolytic silicon substituent group. When the amount of water exceeds 500%, the storage stability of the reaction product tends to be deteriorated, and the charge transporting organic silicon compound tends to be deposited. On the other hand, when the amount of water is less than 30%, the amount of unreacted compounds is increased to cause phase separation upon coating and curing the coating composition, and to cause decrease in strength. It is also preferred to mix an alcohol to increase the storage stability.

In the coating composition production step, it is effective to allow the coating composition to stand for 1 hour or more (aging) after removing the solid catalyst to improve the compatibility of the resulting hard film. The time for allowing to stand the coating composition is preferably from 1 to 250 hours, and more preferably from 2 to 200 hours.

In the hard film forming step, the coating composition is coated and cured to form the hard film. While the curing temperature may be arbitrarily set, it is preferably set at 60° C. or more, and more preferably 80° C. or more, for obtaining the desired strength. The curing time may be arbitrarily set depending on necessity, and is preferably from 10 minutes to 5 hours. It is effective to maintain, after the curing reaction, at a high humidity to stabilize the characteristics. Furthermore, the hydrophobic property may be imparted by conducting a surface treatment using hexamethylsilazane or trimethylchlorosilane, depending on the usage.

The specific hard film is formed, on an electroconductive support, as either a photosensitive layer (a single layer photosensitive layer or an accumulated photosensitive layer (including a charge generating layer and a charge transporting layer)) or a surface protective layer. When either of these layers is formed as the outermost layer, the other constitutions may be the conventionally known constitutions. The respective layers will be specifically described in more detail below.

The electroconductive support will be described below.

Examples of a material of the electroconductive support include a metal, such a aluminum, nickel, chromium and stainless steel, a plastic film having a thin film of aluminum, titanium, nickel, chromium, stainless steel, gold, vanadium, tin oxide, indium oxide or ITO, and paper and a plastic film coated or impregnated with an electroconductivity imparting agent. The electroconductive support may be used in an arbitrary form, such as a drum form, a sheet form and a plate form, but is not limited to these forms. Furthermore, depending on necessity, the surface of the electroconductive support may be subjected to various treatments as far as the image quality is not adversely affected. For example, the surface may be subjected to an oxidation treatment, a chemical treatment, a coloring treatment or a diffused reflection treatment such as fine toothing.

An undercoating layer may be provided depending on necessity between the electroconductive support and the photosensitive layer. Examples of a material of the undercoating layer include an organic zirconium compound, such as a zirconium chelate compound, a zirconium alkoxide compound and a zirconium coupling agent, an organic titanium compound, such as a titanium chelate compound, a titanium alkoxide compound and a titanium coupling agent, and an organic aluminum compound, such as an aluminum chelate compound and an aluminum coupling agent, as well as an organic metallic compound, such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, aluminum titanium alkoxide compound and an aluminum zirconium alkoxide compound, and among these, in particular, an organic zirconium compound, an organic titanium compound and an organic aluminum compound are preferably used since the residual potential is low to exhibit good electrophotographic characteristics.

Furthermore, a silane coupling agent may be used by adding thereto, examples of which include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane. Furthermore, the known binder resins, which have been used in the undercoating layer, may also be used, examples of which include polyvinyl alcohol, polyvinyl methyl ether, poly-N-vinylimidazole, polyethylene oxide, ethyl cellulose, methyl cellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid and polyacrylic acid.

The undercoating layer may also be formed by mixing or dispersing an electron transporting pigment. Examples of the electron transporting pigment include an organic pigment, such as a perylene pigment, a bisbenzimidazole perylene pigment, a polycyclic quinone pigment, an indigo pigment and a quinacridone pigment, described in JP-A-47-30330, an organic pigment, such as a bisazo pigment and a phthalocyanine pigment, having an electron attracting substituent, such as a cyano group, a nitro group, a nitroso group and a halogen atom, and an inorganic pigment, such as zinc oxide and titanium oxide. Among these pigments, a perylene pigment, a bisbenzimidazole perylene pigment and a polycyclic quinone pigment are preferred since the electron mobility is large. When the amount of the electron transporting pigment is too large, the strength of the undercoating layer may be decreased to form coating defects, and thus it is generally used in an amount of 95% by weight or less, and preferably 90% by weight or less.

The method of mixing or dispersing the electron transporting pigment may be an ordinary method using a ball mill, a roll mill, a sand mill, an attritor or an ultrasonic wave. The mixing or dispersing is conducted in an organic solvent, and any organic solvent may be used as far as it dissolves the organic metallic compound and the resin and does not cause gelation or aggregation when the electron transporting pigment is mixed or dispersed. Specifically, an ordinary organic solvent, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, may be used singly or used in combination of two or more of them.

In general, the thickness of the undercoating layer is suitably from 0.1 to 20 μm, and preferably from 0.2 to 10 μm. As the coating method for providing the undercoating layer, the ordinary methods, such as the blade coating method, the wire bar coating method, the spray coating method, the dip coating method, the bead coating method, an air knife coating method and a curtain coating method, may be used. The coated layer is dried to obtain the undercoating layer, and the drying is conducted at a temperature, at which the solvent can be evaporated to form a film.

The specific hard film may be formed as the undercoating layer. In this case, the materials described in the foregoing may be used in combination. The mixing ratio thereof may be appropriately set depending on necessity, and it is particularly preferred since the electric characteristics become excellent when the ratio of the charge transporting organic silicon compound represented by the general formula (I) is 10% by weight or more, and particularly preferably 20% by weight or more.

The charge generating layer will be described below.

In the case where the specific hard film is formed as the charge generating layer, a dispersion solution of a pigment (a charge generating material) and, depending on necessity, a binder resin are added thereto. A charge generating layer having an increased dispersion stability of the pigment, an increased photosensitivity and stabilized electric characteristics can be thus formed. Furthermore, the similar effect can be obtained by using those obtained by treating the pigment with the charge transporting organic silicon compound represented by the general formula (I).

As the charge generating material, any known materials may be used, and metallic and non-metallic phthalocyanine pigments are particularly preferred. Among them, hydroxygallium phthalocyanine, chlorogallium phthalocyanine, dichlorotin phthalocyanine and titanylphthalocyanine that have specific crystal forms are particularly preferred.

The binder resin may be selected from a wide range of insulating resins as long as they can be cured with the charge transporting organic silicon compound represented by the general formula (I) and also may be selected from an organic photoconductive polymer, such as poly-N-vinylcarbazole, polyvinylanthracene, polyvinylpyrene and polysilane. Preferred examples of the binder resin include a polyvinylbutyral resin, a polyarylate resin (such as a polycondensation product of bisphenol A and phthalic acid), a polycarbonate resin, a polyester resin, a phenoxy resin, a vinyl chloride vinyl acetate copolymer, a polyamide resin, an acrylic resin, a polyacrylamide resin, a polyvinylpyridine resin, a cellulose resin, a urethane resin, an epoxy resin, casein, a polyvinylalcohol resin and a polyvinylpyrrolidone resin. In particular, a resin having a hydroxyl group is preferred, which is liable to cause a reaction, such as crosslinking, with an organic metallic compound. The binder resin may be used singly or as a mixture of two or more of them.

The mixing ratio (weight ratio) of the charge generating material to the charge transporting organic silicon compound represented by the general formula (I) is preferably in the range of from 10/1 to 1/10. The components may be dispersed by the ordinary method, such as a ball mill dispersion method, an attritor dispersion method and a sand mill dispersion method, and it is necessary that the crystal form be not changed by dispersion. It has been confirmed that the crystal form is not changed before and after the dispersion by the dispersion methods conducted in the invention. It is also effective that the particles are dispersed to a particle size of 0.5 μm or less, preferably 0.3 μm or less, and more preferably 0.15 μm or less. Examples of the solvent used upon dispersion include methanol, ethanol, n-propanol, n-butanol, benzyl alcohol, methyl cellosolve, ethyl cellosolve, acetone, methyl ethyl ketone, cyclohexanone, methyl acetate, n-butyl, acetate, dioxane, tetrahydrofuran, methylene chloride, chloroform, chlorobenzene and toluene, which may be used singly or as a mixture of two or more of them.

The thickness of the charge generating layer is generally from 0.1 to 5 μm, and preferably from 0.2 to 2.0 μm. As a coating method for providing the charge generating layer, the ordinary methods, such as the blade coating method, the wire bar coating method, the spray coating method, the dip coating method, the bead coating method, an air knife coating method and a curtain coating method, may be used.

In the case where the charge generating layer is not the outermost layer, a conventionally known charge generating layer, for example, one containing the charge generating material and the binder resin described in the foregoing, may be employed.

The charge transporting layer will be described below.

In the case where the specific hard film is formed as the charge transporting layer, a charge transporting material and a binder resin may be added depending on necessity.

Examples of the charge transporting material include an electron transporting compound, examples of which include a quinone series compound, such as p-benzoquinone, chloranil, bromanil and anthraquinone, a tetracyanoquinodimethane series compound, a fluorenone compound, such as 2,4,7-trinitrofluorenone, a xanthone series compound, a benzophenone series compound, a cyanovinyl series compound and an ethylene series compound, and a hole transporting compound, examples of which include a triarylamine series compound, a benzidine series compound, an arylalkane series compound, an aryl substituted ethylene series compound, a stylbene series compound, an anthracene series compound and a hydrazone series compound. The charge transporting materials may be used singly or as a mixture of two or more of them, and are not limited to these examples.

As the charge transporting material, a polymer charge transporting material may also be used. As the polymer charge transporting material, known materials, such as poly-N-vinylcarbazole and polysilane, having charge transporting property may be used. In particular, the polyester series polymer charge transporting materials described in JP-A-8-176293 and JP-A-8-208820 are especially preferred since they have high charge transporting property.

The binder resin is not particularly limited as far as it can be cured with the charge transporting organic silicon compound represented by the general formula (I). Examples thereof include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, polysilane, and a polymer charge transporting material, such as a polyester series polymer charge transporting material described in JP-A-8-176293 and JP-A-8-208820.

The mixing ratio (weight ratio) of the charge transporting material to the charge transporting organic silicon compound represented by the general formula (I) is preferably from 10/1 to 1/5.

In the charge transporting layer, at least one kind of an electron accepting substance may be contained for improving the sensitivity, decreasing the residual potential and fatigue on repeated use. Examples of the electron accepting substance include succinic anhydride, maleic anhydride, diboromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, a benzene derivative having an electron attracting substituent, such as fluorenone series, quinone series, Cl, CN and $NO_2$, is particularly preferred.

In general, the thickness of the charge transporting layer is suitably from 5 to 50 μm, and preferably from 10 to 30 μm. As the coating method, the ordinary methods, such as the blade coating method, the wire bar coating method, the spray coating method, the dip coating method, the bead coating method, an air knife coating method and a curtain coating method, may be used. Examples of the solvent used on providing the charge transporting layer include an aromatic hydrocarbon, such as benzene, toluene, xylene and chlorobenzene, a ketone, such as acetone and 2-butanone, a halogenated aliphatic hydrocarbon, such as methylene chloride, chloroform and ethylene chloride, and a cyclic or linear ether, such as tetrahydrofuran and ethyl ether, which may be used singly or as a mixture of two or more of them.

In the case where the charge transporting layer is not the outermost layer, a conventionally known charge transporting layer, for example, one containing the charge transporting material and, depending on necessity, the binder resin described in the foregoing, may be employed.

The single layer photosensitive layer will be described below.

In the case where the specific hard film is formed as a single layer photosensitive layer, a charge generating material, and depending on necessity, a charge transporting material and a binder resin are added thereto. As these materials, those described in the foregoing may be employed. The charge generating material is generally added to the single layer photosensitive layer in a content of from 10 to 85% by weight, and preferably from 20 to 50% by weight. The addition amount of the charge transporting material is preferably from 5 to 50% by weight. As the solvent and the coating method for coating, ones similar to those described for the charge generating layer and the charge transporting layer may be employed. The film thickness is preferably about from 5 to 50 μm, and more preferably from 10 to 40 μm.

In the case where the single layer photosensitive layer is not the outermost layer, a conventionally known single layer photosensitive layer, for example, one containing the charge transporting material and, depending on necessity, the charge transporting material and the binder resin, may be employed.

The surface protective layer (overcoat layer) will be described below.

The surface protective layer is provided on the photosensitive layer to prevent chemical modification of charge transporting layer upon charging the photosensitive layer formed of an accumulated structure and to improve the mechanical strength of the photosensitive layer.

In the case where the specific hard film is formed as the surface protective layer, an electroconductive material and a binder resin may be added in the coating composition production step depending on necessity.

Examples of the electroconductive material include a metallocene compound, such as N,N'-dimethylferrocene, an aromatic amine compound, such as N,N'-diphenyl-N,N'-bis (3-methylphenyl)-[1,1'-biphenyl]-4,4'-diamine, and a metallic oxide, such as antimony oxide, tin oxide, titanium oxide, indium oxide and tin oxide-antimony oxide, and it is not limited to these examples.

The binder resin is not particularly limited as far as it is compatible with the charge transporting organic silicon compound represented by the general formula (I), and the known resins may be employed, examples of which include a polyamide resin, a polyurethane resin, a polyester resin, an epoxy resin, a polyketone resin, a polycarbonate resin, a polyvinylketone resin, a polystyrene resin, a polyacrylamide resin, a polyimide resin, a polyamideimide resin and a polyetherimide resin.

In the case where the specific hard film is formed as the surface protective layer, the thickness thereof is generally from 0.5 to 10 $\mu$m, and preferably from 0.7 to 8 $\mu$m. As the coating method, the ordinary methods, such as the blade coating method, the wire bar coating method, the spray coating method, the dip coating method, the bead coating method, an air knife coating method and a curtain coating method, may be used.

The layers described in the foregoing are covered with the outermost layer containing the specific hard film to increase the mechanical strength of the surface of the electrophotographic photoreceptor, and thus the electrophotographic photoreceptor has a long service life. As a result, the electrophotographic photoreceptor is in contact with an oxidative gas, light and heat for a longer period of time, and therefore stronger oxidation resistance than the conventional product becomes necessary. Thus, in order to prevent deterioration due to an oxidative gas, such as ozone generated by a charging device, light and heat, an antioxidant, a light stabilizer and a heat stabilizer may be added to the layers. Examples of the antioxidant include hindered phenol, hindered amine, paraphenylenediamine, arylalkane, hydroquinone, spirochroman, spiroindanone, a derivative of them, an organic sulfur compound and an organic phosphor compound. Examples of the light stabilizer include derivatives of benzophenone, benzotriazole, dithiocarbamate and tetramethylpiperidine. The addition amount thereof is preferably 15% by weight or less, and more preferably 10% by weight or less.

Figure 2:
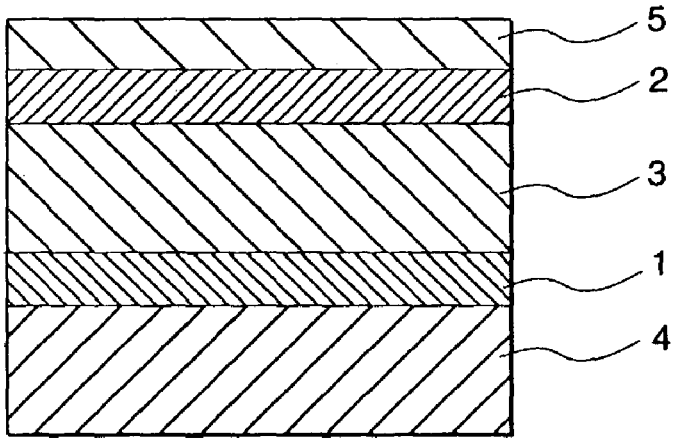
FIG. 2 is a schematic cross sectional view of another example of an electrophotographic photoreceptor used in an apparatus for forming an image according to the invention.
Figure 3:
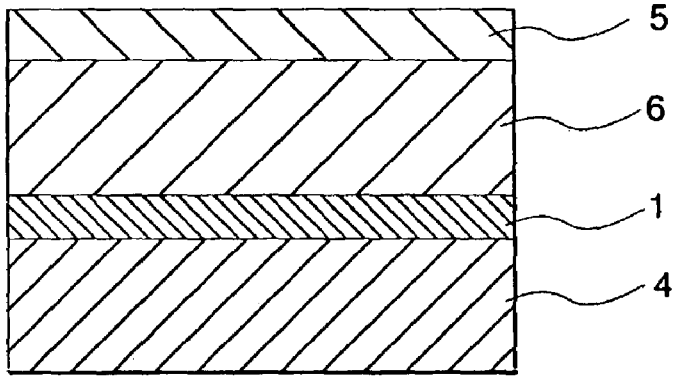
FIG. 3 is a schematic cross sectional view of a further example of an electrophotographic photoreceptor used in an apparatus for forming an image according to the invention.
Figure 4:
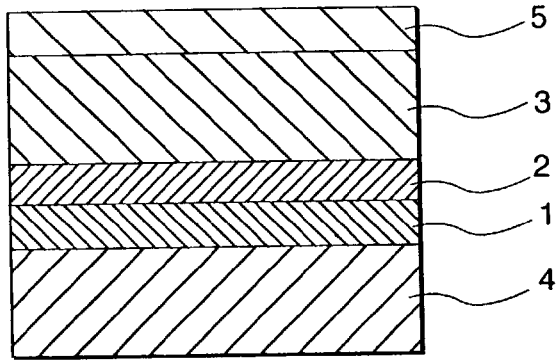
FIG. 4 is a schematic cross sectional view of a still further example of an electrophotographic photoreceptor used in an apparatus for forming an image according to the invention.
Figure 5:
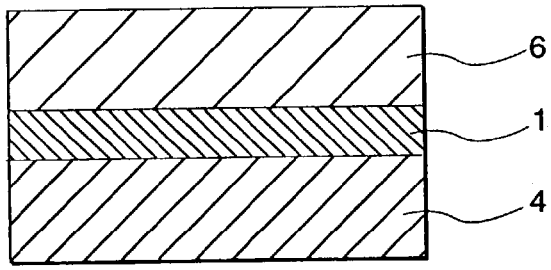
FIG. 5 is a schematic cross sectional view of a still further example of an electrophotographic photoreceptor used in an apparatus for forming an image according to the invention.

FIGS. 1 to 5 are schematic cross sectional views showing examples of the electrophotographic photoreceptor used in the apparatus for forming an image according to the invention. Examples having a photosensitive layer of an accumulated structure are shown in FIGS. 1 to 3, and examples of a single layer structure are shown in FIGS. 4 and 5.

In the electrophotographic photoreceptor shown in FIG. 1, an undercoating layer 1, a charge generating layer 2 and a charge transporting layer 3 (a charge transporting layer containing the specific hard film) are provided in this order on an electroconductive support 4.

In the electrophotographic photoreceptor shown in FIG. 2, an undercoating layer 1, a charge transporting layer 3, a charge generating layer 2 and a surface protective layer 5 (a surface protective layer containing the specific hard film) are provided in this order on an electroconductive support 4.

In the electrophotographic photoreceptor shown in FIG. 3, an undercoating layer 1, a single layer photosensitive layer 6 and a surface protective layer 5 (a surface protective layer containing the specific hard film) are provided in this order on an electroconductive support 4.

In the electrophotographic photoreceptor shown in FIG. 4, an undercoating layer 1, a charge generating layer 2, a charge transporting layer 3 and a surface protective layer 5 (a surface protective layer containing the specific hard film) are provided in this order on an electroconductive support 4.

In the electrophotographic photoreceptor shown in FIG. 5, an undercoating layer 1 and a single layer photosensitive layer 6 (a single layer photosensitive layer containing the specific hard film) are provided in this order on an electroconductive support 4.

The apparatus for forming an image according to the invention may have any constitution except for having an electrophotographic photoreceptor having the specific hard film as the outermost layer. Specifically, it has known units appropriately selected depending on necessity from a charging unit, an exposing unit, such as a laser optical system and an LED array, a developing unit for forming a toner image by using a toner, a transferring unit for transferring the toner image to a recording medium (for example, paper), a fixing unit for fixing the toner image to the recording medium (for example, paper), a cleaning unit for removing the toner and dusts attached on the electrophotographic photoreceptor, a static eliminating unit for removing the electro static latent image remaining on the surface of the electrophotographic photoreceptor, and an abrading unit for abrading the surface of the electrophotographic photoreceptor in one cycle of the electrophotographic process. Furthermore, as described later, the electrophotographic photoreceptor having the specific hard film as the outermost layer may be installed, as a process cartridge provided with the same, in the apparatus for forming an image.

As the charging unit, the conventional non-contact method by corotron and scorotron, or the conventional contact method by a charging roll may be employed. However, the non-contact method using corotron and scorotron forms a large amount of ozone and $NO_x$ and a stronger stress causing image deterioration of the photoreceptor, and thus the photoreceptor should be abraded in a larger amount. Therefore, the contact charging method is preferred since the generation amount of ozone and $NO_x$ is small.

The form of an electroconductive member in the charging unit of a contact charging method may be either a brush form, a blade form, a pin electrode form or a roller form, and a roller form member is preferred.

The roller form member is generally formed with, from the outside, a resistance layer, an elastic layer supporting it, and a core material. Furthermore, a protective layer may be formed outside the resistance layer depending on necessity.

Examples of a material for the core material include those having electroconductivity, such as iron, copper, brass, stainless steel, aluminum and nickel. Also a resin molding etc., dispersed other electroconductive particles etc., can be used.

Examples of a material for the elastic layer include those having electroconductivity or semiconductivity, such as a rubber material having electroconductive particles or semiconductive particles dispersed therein. Examples of the rubber material include EPDM, polybutadiene, natural rubber, polyisobutyrene, SBR, CR, NBR, silicone rubber, urethane rubber, epichlorohydrine rubber, SBS, a thermoplastic elastomer, norbornene rubber, fluorosilicone rubber,and ethylene oxide rubber. Examples of the electroconductive particles or the semiconductive particles include carbon black, a metal, such as zinc, aluminum, copper, iron, nickel, chromium and titanium, and a metallic oxide, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO, which may be used singly or as a mixture of two or more of them.

Examples of a material for the resistance layer and the protective layer include a binder resin having electroconductive particles or semiconductive particles dispersed therein to control the resistance thereof, and the resistivity thereof is generally from $10^3$ to $10^{14}$ Ω·cm, preferably from $10^5$ to $10^{12}$ Ω·cm, and more preferably from $10^7$ to $10^{12}$ Ω·cm. The film thickness is generally from 0.01 to 1,000 μm, preferably from 0.1 to 500 μm, and more preferably from 0.5 to 100 μm. Examples of the binder resin include an acrylic resin, a cellulose resin, a polyamide resin, methoxymethylated nylon, ethoxymethylated nylon, a polyurethane resin, a polycarbonate resin, a polyester resin, a polyethylene resin, a polyvinyl resin, a polyarylate resin, a polythiophene resin, a polyolefin resin, such as PFA, FEP and PET, and a styrene-butadiene resin. Examples of the electroconductive particles and the semiconductive particles include, as similar to the elastic layer, carbon black, a metal and a metallic oxide. Furthermore, an antioxidant, such as hindered phenol and hindered amine, and filler, such as clay and kaolin, and a lubricating agent, such as a silicone oil, may be added thereto depending on necessity. Examples of the method for forming the layers include the blade coating method, the wire bar coating method, the spray coating method, the dip coating method, the bead coating method, an air knife coating method and a curtain coating method.

In the method of charging the electrophotographic photoreceptor by the charging unit of a contact charging method, a voltage is applied to the electroconductive member, and the applied voltage is preferably a direct current voltage or a direct current voltage having an alternating current voltage overlapped. With respect to the range of voltage, the direct current voltage is preferably a positive or negative voltage of from 50 to 2,000 V depending on the required charging voltage of the photoreceptor and more preferably from 1,000 to 1,500 V, and in the case where an alternating current voltage is overlapped, the voltage between peaks is generally from 400 to 1,800 V, preferably from 800 to 1,600 V, and more preferably from 1,200 to 1,600 V. The frequency of the alternating current voltage is generally from 50 to 20,000 Hz, and preferably from 100 to 5,000 Hz.

In the charging unit of the contact charging method, the form thereof and the applied voltage are appropriately selected to control the wear rate of the outermost layer of the electrophotographic photoreceptor.

As the cleaning unit, a method using a cleaning blade having rubber elasticity is considerably preferred from the standpoint of cost and reduction in size, and examples of a material thereof include urethane rubber, silicone rubber, polyimide-modified silicone rubber and fluorine rubber. In the cleaning unit, the form thereof and the contact pressure onto the electrophotographic photoreceptor are appropriately selected to control the wear rate of the outermost layer of the electrophotographic photoreceptor.

A unit of making the surface of the electrophotographic photoreceptor in contact with inorganic fine particles is provided to positively abrade the surface of the electrophotographic photoreceptor, so as to control the wear rate of the outermost layer of the electrophotographic photoreceptor. Specifically, it is attained by a method of providing an abrading device between a transfer part, where a toner is transferred to a recording medium, and a charging part, and a method of contacting the inorganic fine particles.

In the case where the abrading device is provided, an abrading device using an abrading roller or an abrading pad is preferably used. In the case of contacting the inorganic fine particles, it is attained by a method of externally adding the inorganic fine particles to the toner in the developing unit, and a method of using the inorganic fine particles in combination in the abrading device. Examples of the inorganic fine particles herein include cerium oxide, strontium titanate, silicon carbide, alumina and titanium oxide having a particle diameter of from 0.005 to 2 μm.

The developing unit may be appropriately selected depending on the object, and examples thereof include the known developing device, in which development is conducted by contacting or non-contacting a one-component developer or a two-component developer by a brush or a roller. It is preferred that the developing unit contains a mechanism for easily recharging a toner or a developer (herein, the developer contains a toner and a carrier) from the standpoint of prolongation of the service life of the apparatus for forming an image and a process cartridge described later. For example, it is considerably effective to use a mechanism, in which the developing unit is arranged in the apparatus for forming an image or the process cartridge in an easily detachable manner with screws or clips without adhesion or fusion, whereby the toner can be easily recharged without breakage of the apparatus for forming an image or the process cartridge, or to provide a drawspan for recharging the toner or the developer in the developing unit. In this case, it is effective to provide the similar drawspan in the apparatus for forming an image or the process cartridge. By using such a constitution, large reduction in cost can be realized since the toner can be easily recharged from a toner bottle, and the environmental load can also be reduced by prolonging the service life of the apparatus for forming an image or the process cartridge.

Figure 6:
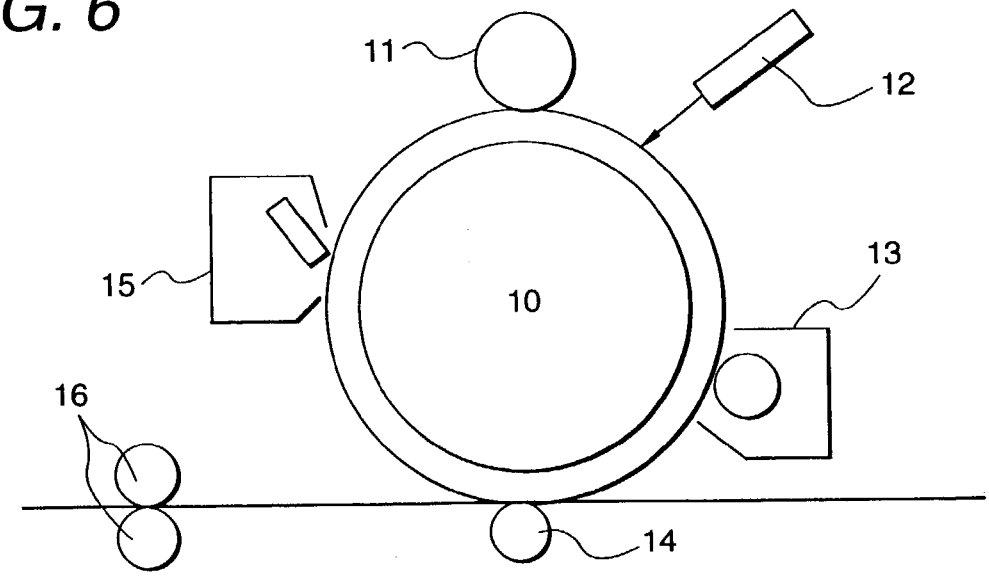
FIG. 6 is a schematic diagrammatic view of an example of an apparatus for forming an image according to the invention.
Figure 7:
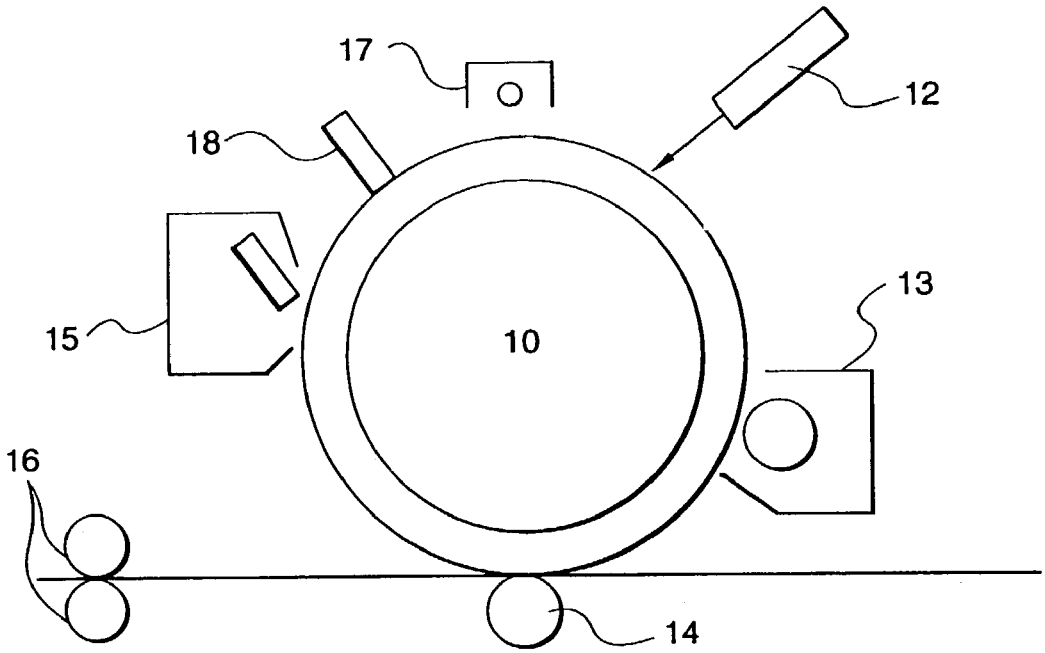
FIG. 7 is a schematic diagrammatic view of another example of an apparatus for forming an image according to the invention.

FIGS. 6 and 7 are schematic diagrammatic views of examples of an apparatus for forming an image according to the invention.

The apparatus for forming an image shown in FIG. 6 contains an electrophotographic photoreceptor 10 having the specific hard film as the outermost layer, a contact charging device 11 using a charging roll, a laser exposing optical system 12, a developing device 13 using a powder toner, a transfer roll 14, a cleaning blade 15 and a fixing roll 16.

The apparatus for forming an image shown in FIG. 7 contains a non-contact charging device 17 of a scorotron charging method instead of the contact charging device 11 using a charging roll in the apparatus for forming an image shown in FIG. 6, and further contains an abrading device 18.

(Process Cartridge)

The process cartridge according to the invention contains an electrophotographic photoreceptor having the specific hard film as the outermost layer, and may further contain units appropriately selected from the charging unit, the exposing unit, the developing unit, the transferring unit, the fixing unit, the cleaning unit, the static eliminating unit and the unit for contacting the inorganic fine particles. The process cartridge is freely attached to and detached from the apparatus for forming an image, whereby an operator can enjoy such advantages that contamination of hands and clothes due to a toner can be avoided, a unit, such as an electrophotographic photoreceptor, can be easily replaced in a short period of time at a low cost, and various materials, such as a toner, can be easily supplied in a short period of time at a low cost.

(Process for Regenerating Apparatus for Forming Image and Process Cartridge)

The process for regenerating the apparatus for forming an image and the process cartridge according to the invention is a regeneration method, in which the apparatus for forming an image and the process cartridge of the invention are regenerated by recharging a toner or a developer. Because the apparatus for forming an image and the process cartridge of the invention contain an electrophotographic photoreceptor having the specific hard film as the outermost layer and have a wear rate within the specific range, so as to prolong the service life of the electrophotographic photoreceptor, it can be regenerated by recharging the toner or the developer. It is considerably effective to provide the mechanism of easily recharging the toner or the developer in the developing unit because the process for regenerating the apparatus for forming an image and the process cartridge can be easily conducted.

The invention will be specifically described with reference to the examples, but the invention is not construed as being limited to the examples. All the "parts" in the examples mean "parts by weight".

Production of Basic Photoreceptor 1

A solution containing 20 parts of a zirconium compound (Organotics ZC540, a trade name, produced by Matsumoto Chemical Co., Ltd.), 2.5 parts of a silane compound (A1100, a trade name, produced by Nippon Unicar Co., Ltd.), 2.5 parts of polyvinylbutyral resin (S-Lec BM-S, a trade name, produced by Sekisui Chemical Co., Ltd.) and 45 parts of butanol is coated, by the dip coating method, on an aluminum substrate having an outer diameter of 30 mm having been subjected to a honing treatment, and then subjected to drying by heating at 150° C. for 10 minutes to form an undercoating layer having a film thickness of 1.0 $\mu$m.

1 part of chlorogallium phthalocyanine having strong diffraction peaks at Bragg angles (2θ±0.2°) of 7.4°, 16.6°, 25.5° and 28.3° in an X-ray diffraction spectrum is mixed with 1 part of polyvinylbutyral (S-Lec BM-S, a trade name, produced by Sekisui Chemical Co., Ltd.) and 100 parts of n-butyl acetate and dispersed by treating in a paint shaker along with glass beads for 1 hour, and the resulting coating composition is dip-coated on the undercoating layer, followed by subjecting heat drying at 100° C. for 10 minutes, so as to form a charge generating layer having a film thickness of 0.15 $\mu$m.

A coating composition obtain by dissolving 2 parts of the compound (1) of the following structural formula and 3 parts of a polymer compound (2) (viscosity average molecular weight: 39,000) of the following structural formula in 20 parts of chlorobenzene is coated on the charge generating layer by the dip coating method, and then heated at 110° C. for 40 minutes, so as to form a charge transporting layer having a film thickness of 20 $\mu$m. The thus resulting product is designated as a basic photoreceptor 1.

(1)

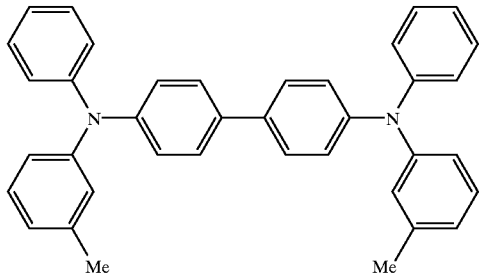

(2)

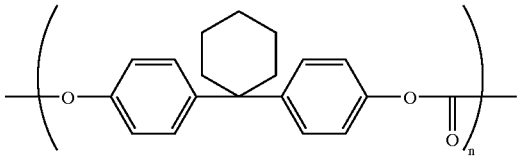

Production of Photoreceptor 1

2 parts each of the following compounds (3) and (4) are dissolved in 5 parts of isopropyl alcohol, 3 parts of tetrahydrofuran and 0.3 part of distilled water, and 0.05 part of an ion exchange resin (Amberlist 15E) is added thereto to conduct hydrolysis by agitating at room temperature for 24 hours. 0.04 part of aluminum trisacetylacetonate is added to 2 parts of solution obtained by removing the ion exchange resin from the hydrolytic product, so as to form a coating composition 1. The coating composition 1 is coated on the basic photoreceptor 1 by a ring type dip coating method and air-dried at room temperature for 30 minutes, followed by curing by subjecting a heat treatment at 120° C. for 1 hour, so as to form a surface protective layer having a film thickness of 3 $\mu$m. The thus resulting product is designated as a photoreceptor 1.

(3)

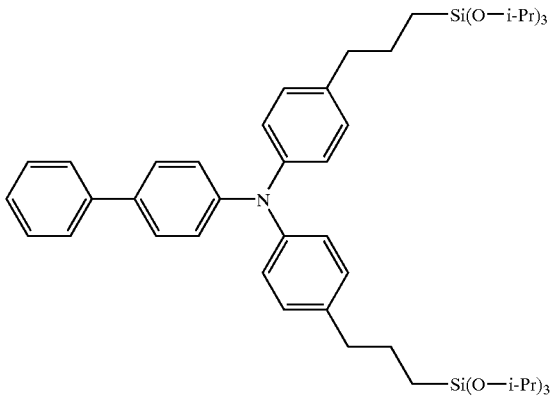

(4)

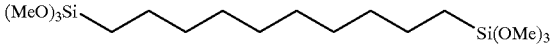

Production of Photoreceptors 2 and 3

A photoreceptor 2 is produced in the same manner as in the production of the photoreceptor 1 except that the surface protective layer is formed by using the following compound (5) instead of the compound (3). A photoreceptor 3 is also produced in the same manner except that the following compound (6) is used instead of the compound (3).

(5)

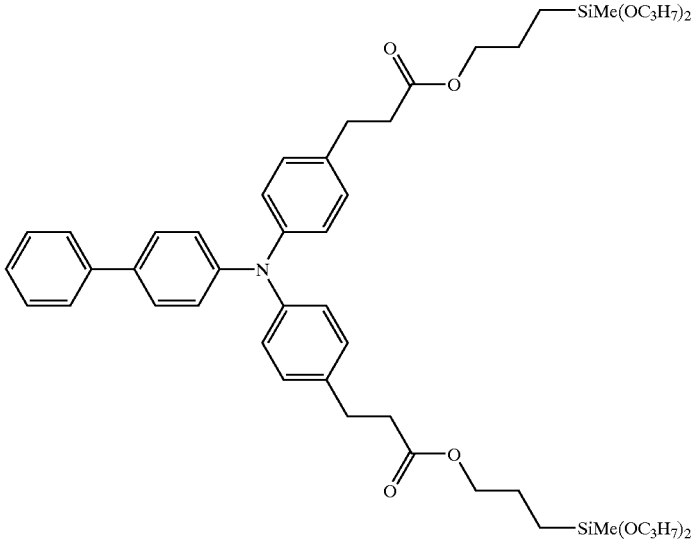

(6)

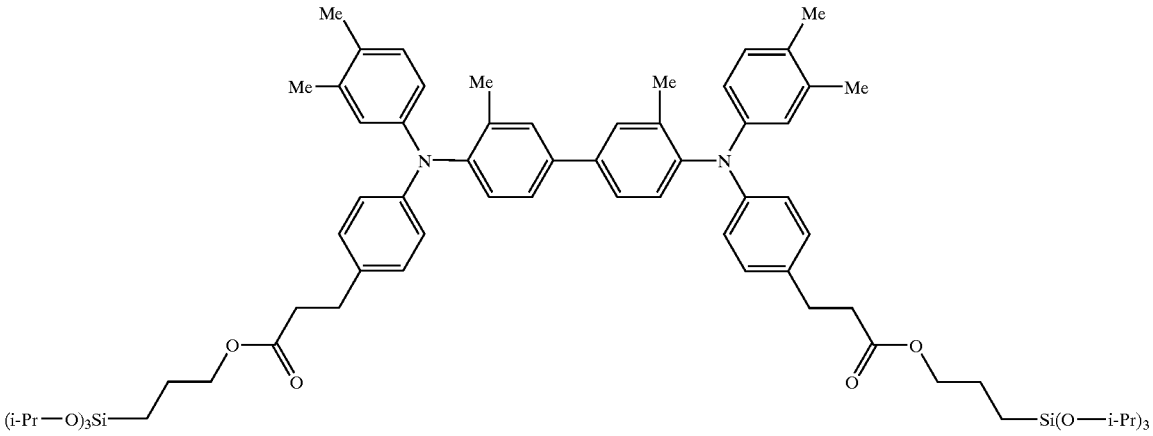

Production of Photoreceptors 4 and 5

A photoreceptor 4 is produced in the same manner as in the production of the photoreceptor 1 except that the surface protective layer is formed by using 1.5 parts of the compound (4) and 0.5 part of methyltrimethoxysilane are used instead of 2 parts of the compound (4). A photoreceptor 5 is also produced in the same manner except that 1.5 parts of the compound (4) and 0.5 part of dimethyldimethoxysilane are used instead of 2 parts of the compound (4).

EXAMPLES 1 TO 5 AND COMPARATIVE EXAMPLE 1

The photoreceptors 1 to 5 and the basic photoreceptor 1 are installed in process cartridges for Laser Press 4160II produced by Fuji Xerox Co., Ltd. In the process cartridges and developing devices provided therein each have a toner supplying opening (drawspan) that can be freely opened and closed by detaching screws to freely supply a toner. Each of the process cartridges is installed in Laser Press 4160II produced by Fuji Xerox Co., Ltd. to conduct a printing test. As evaluation of printing durability, evaluation of image quality before and after printing 50,000 sheets and evaluation of reduction in film thickness of the photoreceptor due to wear are conducted. PPC paper (L, A4) produced by Fuji Xerox Co., Ltd. is used as paper for continuous printing, and the test is conducted under the environment of about 22° C. and 55% RH using the standard test pattern (1R pattern published by The Institute of Image Electronics Engineers of Japan). Furthermore, the are amount of the photoreceptor after printing 50,000 sheets is measured at arbitrary 100 points within the image forming part, the average value of which is designated as the wear amount after printing 50,000 sheets, and the wear rate per 1,000 revolutions of the photoreceptor is calculated from the wear amount.

TABLE 1

| | Photoreceptor | Initial image quality | Image quality after printing 50,000 sheets | Wear rate (nm per 1,000 revolutions) |
|---|---|---|---|---|
| Example 1 | Photoreceptor 1 | good | good | 10 |
| Example 2 | Photoreceptor 2 | good | good | 9 |
| Example 3 | Photoreceptor 3 | good | good | 8 |
| Example 4 | Photoreceptor 4 | good | good | 18 |
| Example 5 | Photoreceptor 5 | good | good | 23 |

TABLE 1-continued

| | Photoreceptor | Initial image quality | Image quality after printing 50,000 sheets | Wear rate (nm per 1,000 revolutions) |
|---|---|---|---|---|
| Comparative Example 1 | Basic photoreceptor 1 | good | Printing density was lowered and image defects were formed. | 85 |

In Examples 1 to 5, after printing 50,000 sheets, image quality of a 256-gradation pattern and 400-line resolution pattern is good (in 400 dpi mode and 600 dpi mode). In the printing test, the toner can be supplied at any time. Since no considerable streak defect is found on the surface, it is considered that the surface is appropriately abraded to abrade attached matters and streak and dot defects on the surface. It is also understood that they had a sufficient strength in comparison to Comparative Example 1.

In Comparative Example 1, although the initial image quality is good, many streak and dot defects are formed on the surface of the photoreceptor after printing 50,000 sheets, and image defects, which is considered to be caused thereby, are also formed. Furthermore, decrease in image density also occurred, which is considered to be caused by the reduction in film thickness.

COMPARATIVE EXAMPLES 2 TO 6

Laser Press 4160II is modified to the scorotron charging type, and the same test as in Example 1 is conducted. The wear amount after printing 2,500 sheets is measured at arbitrary 100 points within the image forming part, the average value of which is designated as the wear amount after printing 2,500 sheets, and the wear rate per 1,000 revolutions of the photoreceptor is calculated therefrom.

TABLE 2

| | Photoreceptor | Initial image quality | Image quality after printing 2,500 sheets | Wear rate (nm per 1,000 revolutions) |
|---|---|---|---|---|
| Comparative Example 2 | Photoreceptor 1 | good | Image defects are formed. | 2 |
| Comparative Example 3 | Photoreceptor 2 | good | Image defects are formed. | 2 |
| Comparative Example 4 | Photoreceptor 3 | good | Image defects are formed. | 2 |
| Comparative Example 5 | Photoreceptor 4 | good | Image defects are formed. | 2 |
| Comparative Example 6 | Photoreceptor 5 | good | Image defects are formed. | 2 |

In Comparative Examples 2 to 6, the wear rates of all the photoreceptors became too small by replacing the charging device to the scorotron charging type, and thus image defects, such as attachments and image flow, are formed after printing 2,500 sheets. After printing about 5,000 to 7,000 sheets, image defects became further severe, and then the test is terminated after printing 10,000 sheets.

EXAMPLES 6 AND 7 AND COMPARATIVE EXAMPLES 7 to 9

The same printing test of 10,000 sheets was conducted as in Comparative Example 2 under such conditions that cerium oxide having a particle diameter of 0.1 $\mu$m was added to a toner used in Laser Press 4160II, and the pressing force of the cleaning blade was increased at 1.5 times. The wear amount after printing 10,000 sheets was measured at arbitrary 100 points within the image forming part, the average value of which was designated as the wear amount after printing 10,000 sheets, and the wear rate per 1,000 revolutions of the photoreceptor was calculated therefrom.

TABLE 3

| | Photoreceptor | Initial image quality | Image quality after printing 10,000 sheets | Wear rate (nm per 1,000 revolutions) |
|---|---|---|---|---|
| Comparative Example 7 | Photoreceptor 1 | good | Image defects are formed. | 3 |
| Comparative Example 8 | Photoreceptor 2 | good | Image defects are formed. | 3 |
| Comparative Example 9 | Photoreceptor 3 | good | Image defects are formed. | 3 |
| Example 6 | Photoreceptor 4 | good | good | 5 |
| Example 7 | Photoreceptor 5 | good | good | 6 |

In Examples 6 and 7, all the photoreceptors are appropriately abraded, and a good image can be obtained even after printing 10,000 sheets. In Comparative Examples 7 to 9, on the other hand, the wear amount of the photoreceptor is too small, and image defects are formed after printing 10,000 sheets.

EXAMPLES 8 TO 10

The same printing test of 10,000 sheets is conducted as in Comparative Example 7 under such conditions that an abrading device formed by adhering a wrapping film (#1000, produced by 3M Corp.) on sponge is arranged between the blade cleaner and the scorotron charging device of the Laser Press 4160II used in Comparative Example 7. The wear amount after printing 10,000 sheets is measured at arbitrary 100 points within the image forming part, the average value of which is designated as the wear amount after printing 10,000 sheets, and the wear rate per 1,000 revolutions of the photoreceptor is calculated therefrom.

TABLE 4

| | Photoreceptor | Initial image quality | Image quality after printing 10,000 sheets | Wear rate (nm per 1,000 revolutions) |
|---|---|---|---|---|
| Example 8 | Photoreceptor 1 | good | good | 6 |
| Example 9 | Photoreceptor 2 | good | good | 8 |
| Example 10 | Photoreceptor 3 | good | good | 8 |

In Examples 8 to 10, all the photoreceptors are appropriately abraded, and a good image can be obtained even after printing 10,000 sheets.

It is understood from Examples and Comparative Examples that because the electrophotographic photoreceptor in the apparatus for forming an image of the invention has, as the outermost layer, the hard film containing the charge transporting organic silicon compound represented by the general formula (I), it has the electrical characteristics and, at the same time, realizes a large mechanical strength. By using it with the specific wear rate corresponding to the species and the thickness, it can be used with good image quality for a long period of time, and can be reused only by recharging the toner, whereby the running cost of printing can be suppressed.

As described in the foregoing, according to the invention, an apparatus for forming an image that can stably provide an image for a long period of time can be provided by using an electrophotographic photoreceptor having, as the outermost layer, a hard film containing one or more of a charge transporting organic silicon compound.

What is claimed is:

1. A method for regenerating an image forming apparatus, comprising:

abrading a photoreceptor having, as an outermost layer, a hard film formed by hydrolytic condensation and curing of a coating composition containing one or more charge transporting organic silicon compounds represented by the general formula (I):

$$F\text{-}(D\text{-}A)b \quad (I)$$

wherein F represents an organic group derived from a charge transporting compound; D represents a flexible sub-unit; A represents a substituted silicon group having a hydrolytic group represented by —Si(R1)(3-a)Qa, wherein R1 represents hydrogen, an alkyl group or a substituted or unsubstituted aryl group, Q represents a hydrolytic group, and a represents an integer of from 1 to 3, and b represents an integer from 1 to 4, with an abrading device;

controlling a wear rate of the outermost layer from 5 to less than 25 nm per 1000 revolutions of the photoreceptor; and regenerating the image forming apparatus by recharging a toner or developer in the image forming apparatus;

wherein abrading the photoreceptor with the abrading device comprises abrading the outermost surface of the photoreceptor with inorganic fine particles having a diameter from 0.005 to 2 $\mu$m.

2. The method according to claim 1, wherein recharging the toner or the developer in the image forming apparatus comprises recharging the toner or the developer in a developing unit.

3. The method according to claim 2, further comprising facilitating the recharging of the toner or the developer in the developing unit with a drawspan in the developing unit.

4. The method according to claim 1, wherein abrading the photoreceptor with the abrading device comprises abrading the outermost surface of the photoreceptor with an abrading roller.

5. The method according to claim 1, wherein abrading the photoreceptor with the abrading device comprises abrading the outermost surface of the photoreceptor with an abrading pad.

6. The method according to claim 1, wherein controlling the wear rate of the outermost layer comprises controlling the wear rate of the outermost layer through a cleaning unit within the image forming apparatus.

7. The process according to claim 1, wherein controlling the wear rate of the outermost layer comprises controlling the wear rate of the outermost layer from 5 to about 20 nm per 1000 revolutions of the photoreceptor.

8. The method according to claim 1, wherein controlling the wear rate of the outermost layer comprises controlling the wear rate of the outermost layer through a charging unit within the image forming apparatus.

9. The process according to claim 1, wherein controlling the wear rate of the outermost layer comprises controlling the wear rate of the outermost layer from 5 to 23 nm per 1000 revolutions of the photoreceptor.

10. A method for regenerating a process cartridge in an image forming apparatus, comprising:

abrading a photoreceptor in the process cartridge having, as an outermost layer, a hard film formed by hydrolytic condensation and curing of a coating composition containing one or more of a charge transporting organic silicon compound represented by the general formula (I), $$F\text{-}(D\text{-}A)b \quad (I)$$

wherein F represents an organic group derived from a charge transporting compound; D represents a flexible sub-unit; A represents a substituted silicon group having a hydrolytic group represented by —Si(R1)(3-a)Qa, wherein R1 represents hydrogen, an alkyl group or a substituted or unsubstituted aryl group, Q represents a hydrolytic group, and a represents an integer of from 1 to 3, and b represents an integer from 1 to 4;

controlling a wear rate of the outermost layer from 5 to less than 25 nm per 1000 revolutions of the photoreceptor; and regenerating the process cartridge by recharging a toner or developer in the process cartridge;

wherein abrading the photoreceptor comprises abrading the outermost surface of the photoreceptor with inorganic fine particles having a particle diameter from 0.005 to 2 $\mu$m.

11. The method according to claim 10, wherein recharging the toner or the developer in the process cartridge comprises recharging the toner or the developer in a developing unit.

12. The method according to claim 11, further comprising facilitating the recharging of the toner or the developer in a developing unit with a drawspan in the developing unit.

13. The method according to claim 10, wherein controlling the wear rate of the outermost layer comprises controlling the wear rate of the outermost layer through a cleaning unit within the image forming apparatus.

14. The method according to claim 10, wherein controlling the wear rate of the outermost layer comprises controlling the wear rate of the outermost layer through a charging unit of at least one of the image forming apparatus and the process cartridge.

15. The process according to claim 10, wherein controlling the wear rate of the outermost layer comprises controlling the wear rate of the outermost layer from 5 to 23 nm per 1000 revolutions of the photoreceptor.

* * * * *